US005763991A

United States Patent [19]

Yoon et al.

[11] Patent Number: 5,763,991

[45] Date of Patent: Jun. 9, 1998

[54] ELECTRON GUN FOR A COLOR PICTURE TUBE

[75] Inventors: Hyo-jong Yoon, Taeku, Rep. of Korea; Francis Joseph Campbell, Yardley, Pa.

[73] Assignee: Orion Electric Co., Kyungsangbok-do, Rep. of Korea

[21] Appl. No.: 346,882

[22] Filed: Nov. 30, 1994

[30] Foreign Application Priority Data

Nov. 30, 1993 [KR] Rep. of Korea ..... 93-26170

[51] Int. Cl.[6] ..... H01J 29/50

[52] U.S. Cl. ..... 313/412; 313/414

[58] Field of Search ..... 313/412, 414, 313/421, 425, 429

[56] References Cited

U.S. PATENT DOCUMENTS

| | | | |
|---|---|---|---|
| 4,429,252 | 1/1984 | Vieland et al. . | |
| 5,038,073 | 8/1991 | Son | 313/414 |
| 5,142,189 | 8/1992 | Sugahara et al. | 313/414 |
| 5,281,896 | 1/1994 | Bae et al. | 315/15 |

FOREIGN PATENT DOCUMENTS

| | | |
|---|---|---|
| A0134059 | 3/1985 | European Pat. Off. . |
| A0173086 | 3/1986 | European Pat. Off. . |

OTHER PUBLICATIONS

Patent Abstracts of Japan, vol. 15, No. 108 (E-1045), Mar. 14, 1991, Patent Publication No. JP-A-03 001 429, Jan. 8, 1991.

Patent Abstracts of Japan, vol. 17, No. 549 (E-1443), Oct. 4, 1993, Patent Publication No. JP-A-05 159 719, Jun. 25, 1993.

*Primary Examiner*—Sandra L. O'Shea
*Assistant Examiner*—Mack Haynes
*Attorney, Agent, or Firm*—Morgan & Finnegan LLP

[57] ABSTRACT

The present invention discloses an improved electron gun for a color picture tube including a main lens having a first rim electrode having a beam passing plane with holes in an incident side of the electron beam and a second rim electrode facing the first rim electrode and having a beam passing plane with holes in a departing side of the beam. A focusing electrode having a beam passing plane with holes in departing side of the beam for forming compensating astigmatism quadrupole lenses in conjunction with the first rim electrode to compensate for the astigmatism of the main lens is positioned adjacent to the first rim electrode of the main lens. Astigmatism formed between the first and second rim electrode of the main lens electrodes can be reduced by the compensating astigmatism of the quadrupole lenses.

1 Claim, 3 Drawing Sheets

ELECTRON GUN FOR A COLOR PICTURE TUBE

FIELD OF THE INVENTION

The present invention relates to an electron gun for a color picture tube, and particularly to an in-line type gun with improved electrodes forming the main lens.

BACKGROUND OF THE INVENTION

A conventional electron gun for a color picture tube is mounted in the neck of the tube to emit thermions (i.e., electrons or ions). The electron gun comprises a triple electrode part having a cathode as a source of thermions, and a plurality of electrodes for forming an electrostatic lens by differences in potential.

In an in-line type electron gun, three electron beam passing holes are formed in line on two facing sides of two adjacent electrodes, and respectively prescribed voltages are applied to each electrode to form a plurality of equipotential lines, namely the electrostatic lens, thus focusing and accelerating the electron beam passing therethrough. The magnification of the electrostatic lens formed between two electrodes depends upon the size of the beam passing holes and the potential difference between voltages applied to each electrode. The spherical aberration is increased with increasing magnification.

Therefore, the magnification of the lens is conventionally reduced and the diameter of the lens is enlarged to reduce the spherical aberration of the electrostatic lens formed between electrodes.

In FIG. 1, (Prior Art) there is shown an example of a pair of electrodes of the main lens for reducing the spherical aberration.

The system comprises a pair of rim electrode components 11, 21 each having large aperture beam passing holes 11H, 21H, three beams concurrently passing therethrough; and plate electrode components 12, 22, placed independently in rim electrode components 11, 21 to be spaced by a prescribed distance from large aperture beam passing holes 11H, 21H, having three vertically elongated beam passing holes (12R, 12G, 12B), (22R, 22G, 22B), respectively. When prescribed voltages are applied to the electrodes, an electrostatic lens is formed between the two electrodes 10,20 and the lens comprises a large aperture lens formed between large aperture beam passing holes 11H, 21H of rim electrode components 11, 21 and small aperture lenses formed between each of small aperture beam passing holes (12R, 12G, 12B), (22R, 22G, 22B). The electron beam passing through the lens 11H, 21H suffers a converging force in which the vertical component is stronger than the horizontal component of the large aperture lens formed between rim electrode components 11, 21 of oval shape, resulting in a positive astigmatism.

The positive astigmatism is compensated by negative astigmatism by small aperture lenses formed between vertically elongated beam passing holes (12R, 12G, 12B), (22R, 22G, 22B) of plate electrode components 12, 22. In this manner, the astigmatism and the spherical aberration of the beam passing through the electrostatic lens formed between electrodes 10, 20 can be reduced.

However, plate electrode components 12, 22 for compensating the positive astigmatism of rim electrode components 11, 21, are placed at positions recessed a small distance from the edges 11H, 21H of rim electrodes, 11 21, Moreover, as the small aperture lenses formed between the two side small aperture beam passing holes (12R, 12B), (22R, 22B) are asymmetrically formed by the effect of asymmetrical electric field due to side walls of rim electrode components 11, 21, the beam passing side holes (12R, 12B), (22R, 22B) suffers a large spherical aberration.

As the result, an asymmetrical halo occurs at the periphery of the beam spot landing on the screen, and the phenomenon deforms the beam spot into an asymmetrical transversely elongated shape when the beam is deflected into the peripheral portion of the screen by the deflection yoke.

SUMMARY OF THE INVENTION

It is therefore an object of the present invention to provide an electron gun for a color picture tube capable of reducing the overall spherical aberration and correcting the unsymmetric astigmatism generated by the side wall effect of the rim electrode thus obtaining a uniform section of the beam all over the screen.

To achieve the above object, an electron gun according to the present invention includes a first rim electrode of tubular section having a beam passing plane with three beam passing holes on the incident side of the beam for forming a quadrupole lens and a second rim electrode of tubular section adjacent to the first rim electrode, having a beam passing plane with three beam passing holes on the departing side of the beam.

According to one aspect of the present invention, each of the first and second electrodes respectively comprises a tubular main body having upper and lower walls elongated in parallel and two side walls connecting each end of the upper and lower walls, and a beam passing plane closing one end of the main body and having beam passing holes.

BRIEF DESCRIPTION OF THE DRAWINGS

These and other objects and advantages of the present invention will be more apparent from the following detailed description, with reference to the accompanying drawings, in which.

DETAILED DESCRIPTION OF THE INVENTION

Figure 1:
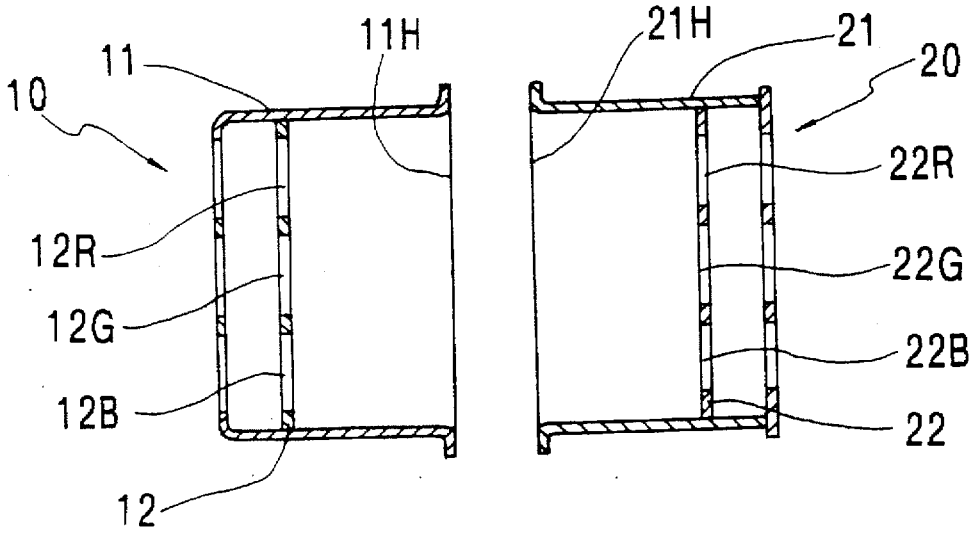
FIG.1 PRIOR ART
FIG. 1 (Prior Art) is a sectional view in the horizontal plane illustrating electrodes for forming a large aperture lens in a conventional electron gun for a color picture tube.
Figure 2:
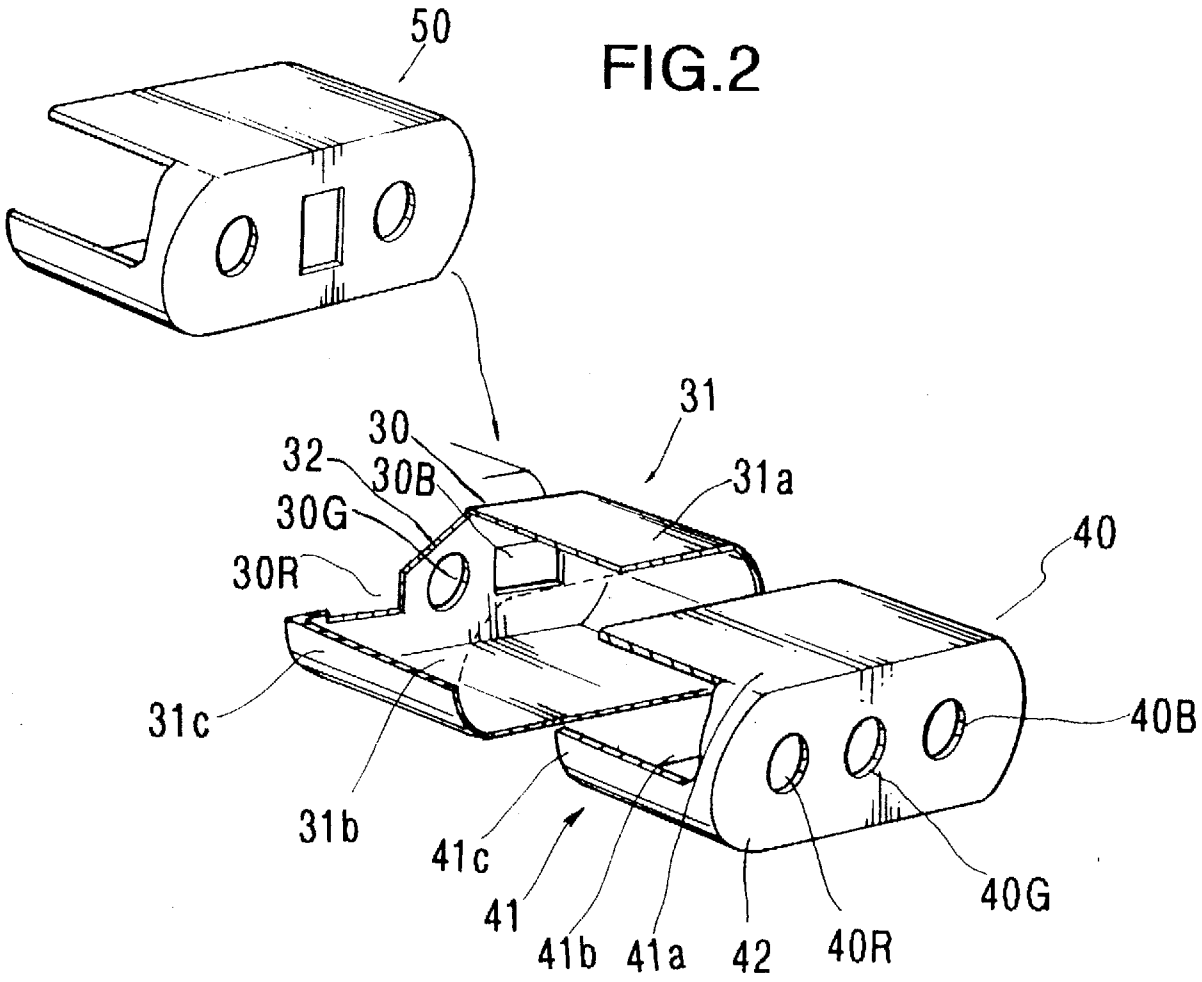
FIG. 2 is a perspective view showing rim electrodes constituting the main lens of an electron gun according to the present invention.

An electron gun for a color picture tube according to one embodiment of the present invention comprises a first rim electrode 30 and a second rim electrode 40 facing each other as electrodes for forming the main lens as shown in FIG. 2. Each of the first and second rim electrodes 30, 40 respectively having upper and lower walls (31*a*, 31*b*), (41*a*, 41*b*) elongated in parallel, a tubular main body 31, 41 having side walls 31*c*, 41*c* extending between either ends of the upper and lower walls (31*a*, 31*b*), (41*a*, 41*b*), and a beam passing plane 32, 42 having beam passing holes and closing the entrance end of the tubular main body 31, and a beam passing plane 42 having beam passing holes and closing the exit end of tubular electrode 41. The beam passing plane 32 of the first rim electrode 30 is placed toward the cathode side (not shown) of the gun to form a quadrupole lens with the focusing electrode 50 of the prefocusing lens part. The beam passing plane 42 in the departing side of the second rim electrode 40 is placed opposite to the cathode. Three beam passing holes are formed at the beam passing plane 32 of the incident side of the first rim electrode 30, the central hole 30G thereof has a circular shape, and two wing holes 30R, 30B are of a transversely elongated shape to form quadrupole lenses with electrode 50 for each beam passing hole. Centers of the two transversely elongated wing holes 30R, 30B are outwardly deviated relative to those of the facing holes of the adjacent electrode 50.

Three beam passing holes 40R, 40G, 40B formed at the beam passing plane 42 in the departing side of the second rim electrode 40, are circular in shape, the diameters of wing holes 40R, 40B being larger than that of central hole 40G.

The operation of the gun according to the present invention will now be described.

Figure 3:
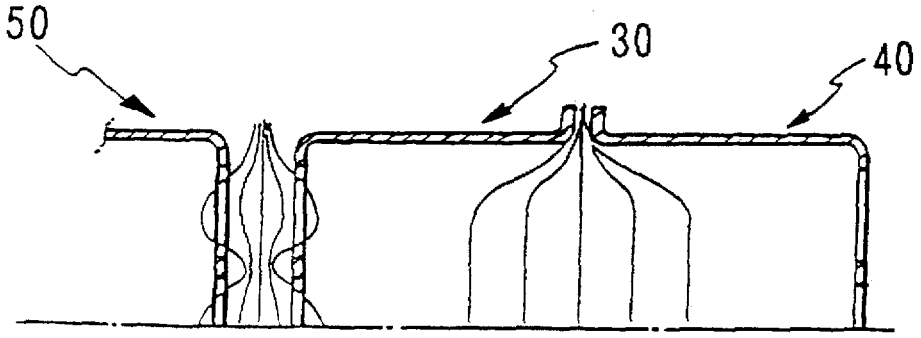
FIG. 3 is a partially sectional view in the horizontal plane of electrodes of FIG. 2.

When respectively prescribed voltages are applied to the first and second rim electrodes 30, 40 and the focusing electrode 50 FIG. 3), a large aperture electrostatic lens is formed between the first and second electrodes 30, 40, and a quadrupole lens is formed between the focusing electrode 50 and the first rim electrode 30. As main bodies 31, 41 of the first and second rim electrodes 30, 40 are oval-tube in shape, the large aperture lens formed therebetween attains a positive astigmatism in which the vertical component of the beam is over-focused compared to the horizontal component. As for the quadrupole lens formed between the focusing electrode 50 and the first rim electrode 30, the horizontal converging force is relatively enhanced to attain a negative astigmatism, as beam passing holes thereof are of a transversely elongated shape. Thus the main lens astigmatism is compensated by the two astigmatisms being offset. As will be understood, in order to achieve the negative astigmatism quadrupole lenses formed in conjunction with the two elongated wing holes 30B, 30R and circular center hole 30G of first rim electrode 30, the beam passing holes of focusing electrode 50 will comprise a vertically elongated central hole and two circular or elongated wing holes (circular wing holes are shown in FIG. 2).

Moreover, as the center of wing holes 30R, 30B of the beam passing plane 32 in the incident side of the first rim electrode 30 is outwardly deviated, and the diameter of wing holes 40R, 40B is larger than that of the central hole 40G of the beam passing plane 42 in the departing side of the second rim electrode 40, the asymmetrical electric field effect due to the side walls of the rim electrodes can be reduced and the side beams can be deflected toward the central beam for convergence.

Central holes 30G, 40G formed in beam passing planes 32, 42 of the first and second rim electrodes 30, 40 are circular in shape, thus allowing to improve the support of electrodes during the assembly of the gun to facilitate the precision of the assembly.

According to the present invention, the positive astigmatism of the electrostatic lens formed by rim electrodes of the main lens is offset by the negative astigmatism of the quadrupole lens of the prefocusing lens part formed by elongated aperatures,thereby reducing the astigmatism of the main lens. Thus the present invention reduces the spherical aberration due to the asymmetry of the main lens and prevents the deterioration of focusing characteristics.

We claim:

1. An electron gun for a color picture tube comprising:

a first rim electrode having a beam passing plane and an opposing rim end, said beam passing plane having three beam passing holes formed therein in an incident side of three electron beams for forming quadrupole lenses, a center hole of said three beam passing holes of said first rim electrode is circular in shape and wing holes of said three beam passing holes of said first rim electrode are outwardly deviated;

a second rim electrode having a second beam passing plane and a rim end, said second beam passing plane having three independent beam passing holes formed therein in a departing side of said beams, said second rim electrode positioned so that said rim of said second electrode faces said rim of said first electrode forming a common lens having astigmatism, said three independent beam passing holes of said second rim electrode are circular in shape, the diameter of the wing holes is larger than that of the center hole; and a focusing electrode having a third beam passing plane in which three beam passing holes are formed in a departing side of said beams for forming quadrupole lenses, said departing side of said third beam plane positioned adjacent to said incident side of said first beam passing plane of said first electrode to form said quadrupole lenses, a center hole of said three beam passing holes of said focus electrode is transversely elongated in shape and wings holes are circular in shape.

* * * * *